US007930799B2

(12) United States Patent
Sutton et al.

(10) Patent No.: US 7,930,799 B2
(45) Date of Patent: Apr. 26, 2011

(54) SURFACE TREATING APPLIANCE

(75) Inventors: John Scott Sutton, Malmesbury (GB); Mark Douglas Whiting, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 12/615,667

(22) Filed: Nov. 10, 2009

(65) Prior Publication Data

US 2010/0132154 A1 Jun. 3, 2010

(30) Foreign Application Priority Data

Nov. 28, 2008 (GB) ..... 0821764.8

(51) Int. Cl.
*A47L 9/00* (2006.01)

(52) U.S. Cl. ..... 15/327.2; 15/347

(58) Field of Classification Search ..... 15/327.2, 15/347, 349, 352, 353
See application file for complete search history.

(56) References Cited

U.S. PATENT DOCUMENTS 4,554,700 A * 11/1985 Lyman ..... 15/323
4,745,654 A * 5/1988 Yamamoto et al. ..... 15/344
5,867,863 A * 2/1999 McCormick ..... 15/351
6,807,707 B2 * 10/2004 Park et al. ..... 15/347
2005/0138757 A1 * 6/2005 Lee ..... 15/327.2
2007/0017062 A1 * 1/2007 Overvaag ..... 15/347

FOREIGN PATENT DOCUMENTS

GB 2 384 972 8/2003
WO WO-2005/112727 12/2005

OTHER PUBLICATIONS

GB Search Report dated Mar. 5, 2009, directed to counterpart GB Application No. 0821764.8; 1 page.

* cited by examiner

*Primary Examiner* — Dung Van Nguyen
(74) *Attorney, Agent, or Firm* — Morrison & Foerster LLP

(57) ABSTRACT

A surface-treating appliance, such as a vacuum cleaner, includes a main body housing a component such as a post-motor filter. A door provides access to the filter. The door is connected to the main body by a hinge arranged to allow the door to pivot about the hinge's rotational axis and to move axially as the door is moved between closed and open positions. The provision of a hinge that can move along its rotational axis permits the door to move laterally as it opens, thereby clearing adjacent parts of the appliance, such as the spine. This allows an appliance to be manufactured that permits the user to access components housed inside of it, but is compact. Preferably, the hinge includes a cam arrangement, so that the door automatically moves away from adjacent parts of the appliance as it moves from the closed position to an open position.

10 Claims, 7 Drawing Sheets

SURFACE TREATING APPLIANCE

REFERENCE TO RELATED APPLICATIONS

This application claims the priority of United Kingdom Application No. 0821764.8, filed Nov. 28, 2008, the entire contents of which are incorporated herein by reference.

FIELD OF THE INVENTION

The present invention relates to a surface-treating appliance, such as a vacuum cleaner.

BACKGROUND OF THE INVENTION

Vacuum cleaners are designed to separate dirt and dust from an airflow. In a typical vacuum cleaner an airflow generator (for example, a motor and fan unit) generates an airflow which draws dirt- and dust-laden air into the vacuum cleaner through a dirty air inlet. The airflow then passes through a form of separating apparatus to remove dirt and dust from the airflow. Some vacuum cleaners make use of a porous bag through which the dirty air is sucked so that the dirt and dust is retained in the bag while cleaned air is exhausted to the atmosphere. In other vacuum cleaners, cyclonic separators are used to separate dirt and dust from the airflow.

Irrespective of the type of separating apparatus used, there is a risk of a small amount of dirt and dust passing through the separating apparatus and being carried to the airflow generator. It is undesirable for dirt and dust particles to pass through the fan of an airflow generator because the fan may become damaged or may operate less efficiently. In order to reduce this problem, some vacuum cleaners include a fine filter in an airflow path between the separating apparatus and the airflow generator. This filter is commonly known as a pre-motor filter and is used to extract fine dirt and dust particles remaining in the airflow after it has passed through the separating apparatus.

During normal operation of a vacuum cleaner, fine dirt and dust may be deposited on the pre-motor filter and, after a period of time, it could become blocked. Blockages reduce the efficiency at which a vacuum cleaner operates. Therefore, the pre-motor filter will occasionally need to be replaced or cleaned in order to maintain the performance of the vacuum cleaner. In order to allow cleaning or replacement of the pre-motor filter, it is common for such filters to be removable from a vacuum cleaner.

It is also known to provide a filter downstream of the airflow generator. This is known as a post-motor filter, and is typically employed to filter carbon dust which may be generated by brushes on the motor, as well as allergens and any microscopic particles of dirt and dust remaining in the airflow. After a period of use, the post-motor filter may need to be cleaned or replaced. Typically, the post-motor filter will need such attention much less frequently than does the pre-motor filter.

It is beneficial to permit the user to be able to monitor the condition of both the pre-motor filter and the post-motor filter, and to remove and replace them as required. To this end, access to one or both of the filters may be provided.

It may also be beneficial to allow the user to access other components of the cleaner, such as the motor and fan unit, the interior of ducts on the main body, or parts of the separating apparatus. In this manner, the user can monitor the condition of these components and clean, repair or replace them.

Conventionally, access to such components has not been provided to the user because of the difficulty in providing access hatches or doors that can open easily and freely. In order to provide such doors, sufficient clearance must be provided between parts of the appliance to allow the doors to open fully. This can result in an appliance having a cumbersome and bulky appearance.

SUMMARY OF THE INVENTION

The invention provides a surface-treating appliance comprising a main body housing a component, and a door arranged to provide access to the component, the door being connected to the main body by a hinge having a rotational axis, in which the hinge is arranged to allow the door to pivot about the rotational axis and to move along the rotational axis as the door is moved between closed and open positions.

The provision of a hinge that can move along its rotational axis permits the door to move laterally as it opens, thereby clearing adjacent parts of the appliance. This allows an appliance to be manufactured that permits the user to access components housed inside of it, but is more compact than was achievable hitherto.

Preferably, the hinge includes a cam arrangement, so that the door automatically moves away from adjacent parts of the appliance as it moves from the closed position to an open position. Where the hinge comprises a pin and a sleeve arranged to be rotate on the pin, the cam may comprise a lug on the pin and a co-operating tapered portion on the sleeve, or vice-versa.

Advantageously, the rotational axis of the hinge is transverse to the spine of the appliance.

Preferably, the door is held in a closed position by a manually-operable catch.

The invention may be employed to give access to any component of a surface-treating appliance, but is of particular benefit in giving access to a filter, as this is the component most likely to need to be monitored by a user. Preferably, the filter is removable by the user and may be washed. This conveniently allows the user to maintain the filters without purchasing extra filters and without the need for a service engineer.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
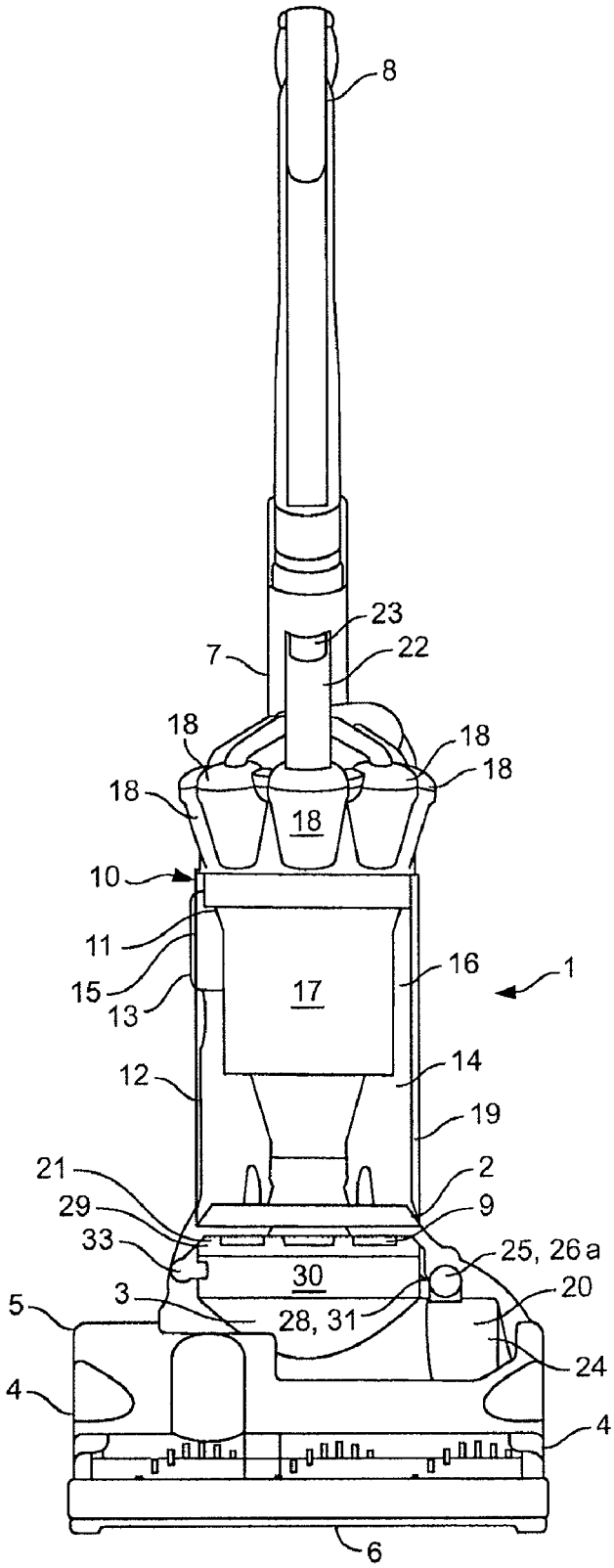
FIG. 1 is a front view of a cleaning appliance constructed according to the invention, in the form of an upright vacuum cleaner.

With reference to FIG. 1, a surface-treating appliance in the form of an upright vacuum cleaner is shown and indicated generally by the reference numeral 1. The vacuum cleaner 1 comprises a main body 2 which includes a motor and fan unit 3 and a pair 4 of wheels. A cleaner head 5 is pivotably mounted on the lower end of the main body 2 and a dirty air inlet 6 is provided in the underside of the cleaner head 5 facing the floor surface. The main body 2 further includes a spine 7 which extends vertically upward and merges into a handle 8. The handle 8 can be manipulated by a user to manoeuvre the vacuum cleaner 1 across a floor surface. The main body 2 further includes outlet ports 9 for exhausting air from the vacuum cleaner 1.

Separating apparatus 10 is releasably held on the main body 2. The separating apparatus 10 comprises a separator 11 and a collecting chamber 12. The separating apparatus 10 is supported on the main body 2 above the outlet ports 9 and lies adjacent the spine 7. The interior of the separating apparatus 10 is in communication with the dirty air inlet 6 through ducting 13 adjacent the spine 7. The separating apparatus 10 can be removed from the main body 2 for emptying and for maintenance.

In use, the motor and fan unit 3 draws dirty air into the vacuum cleaner 1 via the dirty air inlet 6. The dirty air is carried to the separating apparatus 10 via the ducting 13 adjacent the spine 7. The separating apparatus 10 includes an upstream cyclone 14 in the collecting chamber 12. An air inlet 15 is formed in the cylindrical side wall 16 of the collecting chamber 12. When the separating apparatus 10 is held on the main body 2 of the vacuum cleaner 10, the air inlet 15 is in communication with the dirty air inlet 6 and forms a communication path between the ducting 13 adjacent the spine 7 and the interior of the upstream cyclone 14. The air inlet 15 is arranged tangentially to the upstream cyclone 14 so that the incoming air is encouraged to follow a helical path around the interior of the upstream cyclone.

A shroud 17 is located inwardly of the cylindrical side wall 16 of the upstream cyclone 14. The shroud 17 comprises a cylindrical wall having a plurality of through-holes. The shroud 17 provides a communication path between the upstream cyclone 14 and a downstream cyclone assembly.

The downstream cyclone assembly comprises a plurality of downstream cyclones 18 arranged in parallel. In this embodiment, seven downstream cyclones 18 are provided. Each of the downstream cyclones 18 has a diameter smaller than that of the upstream cyclone 14. Therefore, the downstream cyclones 18 are able to separate smaller particles of dirt and dust from the partially-cleaned airflow than the upstream cyclone 14. Separated dirt and dust exits the downstream cyclones 18 and passes into the collecting chamber 12.

Cleaned air then flows back up through the downstream cyclones 18 and enters a duct 19. The cleaned air then passes from the duct 19 to a pre-motor filter 20. The pre-motor filter 20 serves to trap any fine dust or microscopic particles which have not been separated by the two cyclonic separation stages 14, 18. The downstream side of the pre-motor filter 20 communicates with the fan and motor unit 3. This unit 3 accommodates a fan impeller which is driven by a motor to generate the suction airflow. The outlet of the fan and motor unit 3 communicates with a post-motor filter 21. The post-motor filter 21 serves to trap any remaining particles in the airflow, as well as carbon particles from the motor. Air then exits the post-motor filter 21 and is exhausted from the vacuum cleaner 1 through the outlet ports 9.

Figure 2:
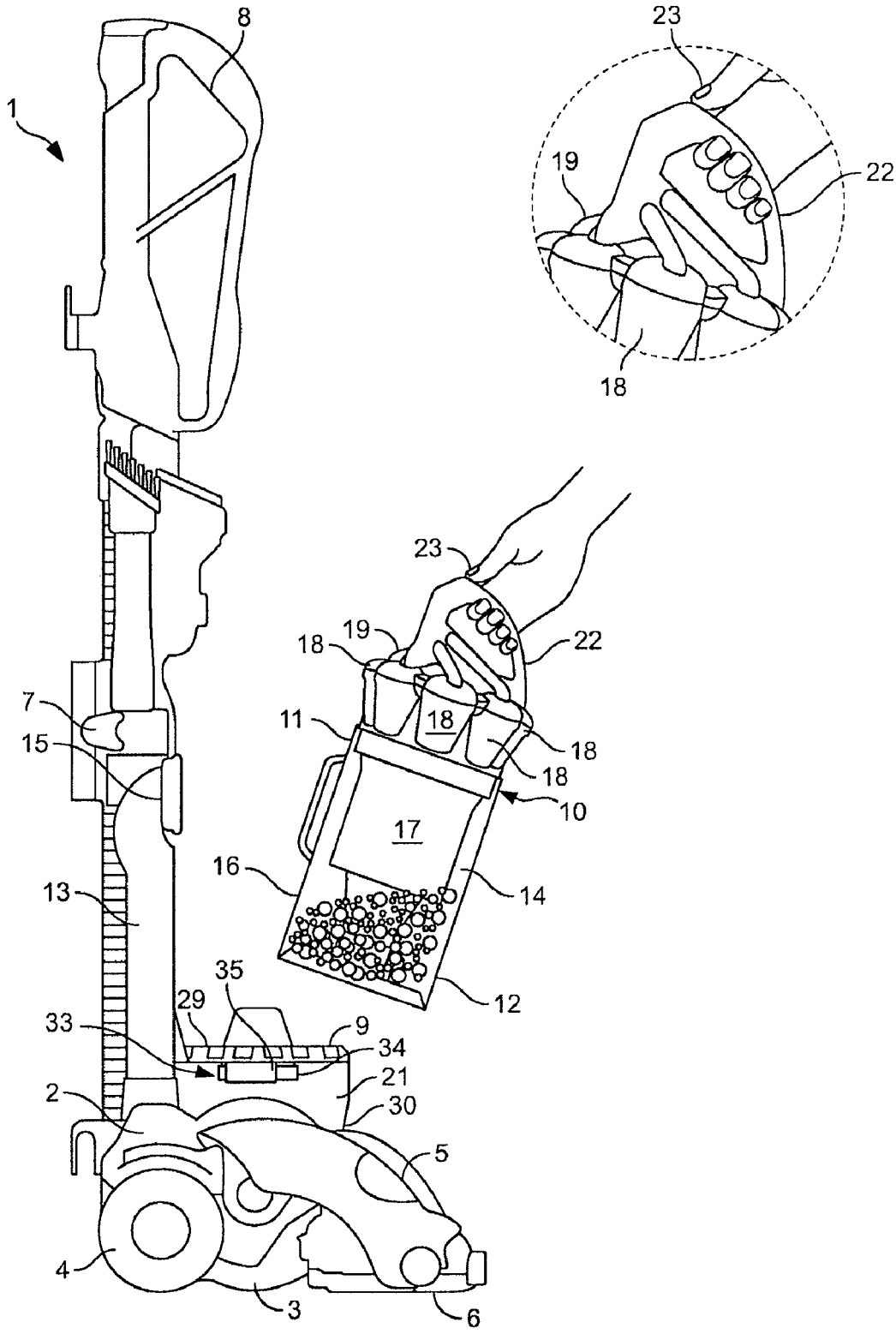
FIG. 2 is a side view of the cleaner of FIG. 1 showing the separating apparatus being removed.

A handle 22 is located over the separating apparatus 10 and is arranged to allow a user to carry the vacuum cleaner 1. When the separating apparatus 10 is released from the main body 2, as is shown in FIG. 2, the handle 22 may also be used to carry the separating apparatus alone. With reference to FIG. 2, a user-operable button 23 is located on the separating apparatus 10 at the upper end portion of the handle 22. By depressing the button 23, the user releases a catch holding the separating apparatus 10 to the main body 2. The user can then place the separating apparatus 10 over a suitable dirt and dust receptacle such as a dustbin for emptying of dirt and dust that has been collected in the collecting chamber 12.

Through use over a period of time, one or both of the pre-motor filter 20 and the post-motor filer 21 may become clogged with dust or dirt. Continued use would lead to a restriction in the airflow through the filters 20, 21, thereby causing a reduction in the efficiency of the vacuum cleaner 1. In order to alleviate this, any filter that becomes clogged must be replaced or washed. Usually, the pre-motor filter 20 will need to be replaced or washed more frequently than the post-motor filter 21; this is simply because the post-motor filter is downstream of the pre-motor filter and therefore receives an airflow that is less dirty. It is important that the user is directed to remove, and check the condition of, the pre-motor filter 20 first.

Figure 3A:
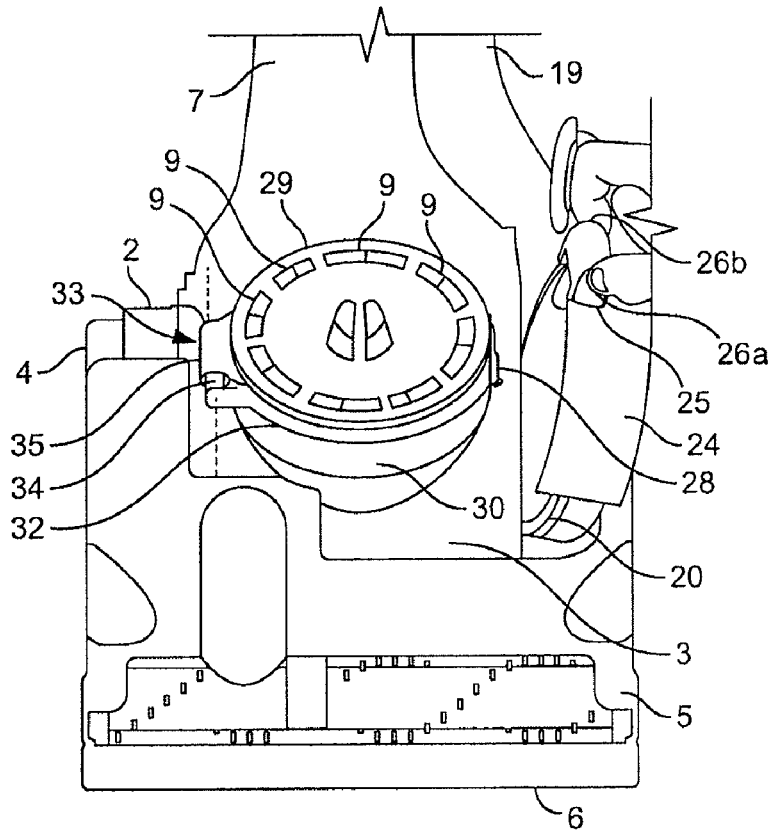
FIG. 3*a* is a front perspective view of part of the cleaner of FIG. 1 showing the pre-motor filter housing being removed.
Figure 3B:
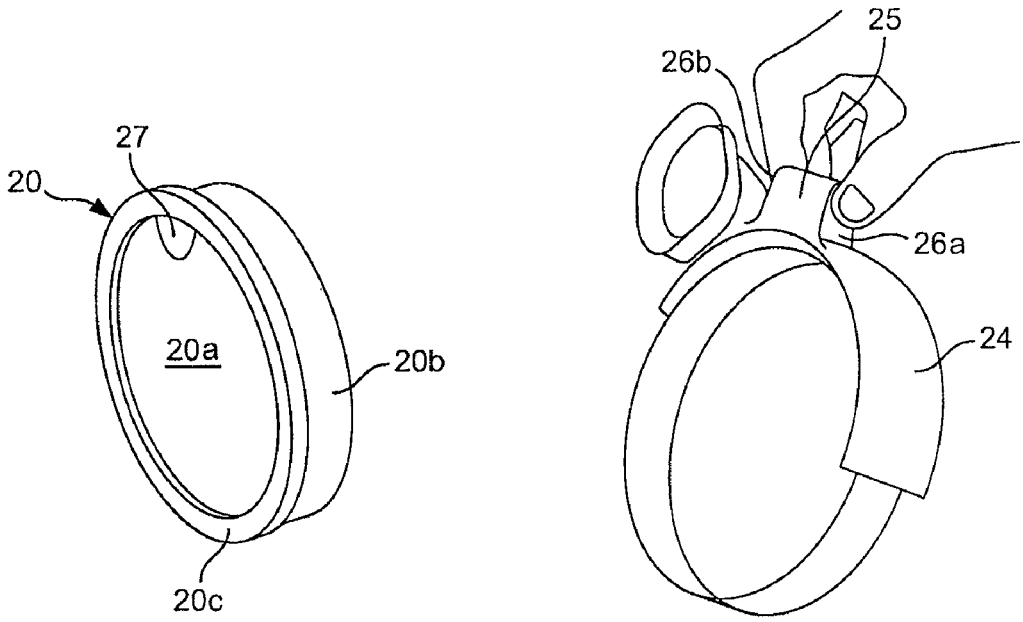
FIG. 3*b* is a perspective view of the pre-motor filter housing of FIG. 3*a*, showing the pre-motor filter being removed.
Figure 5:
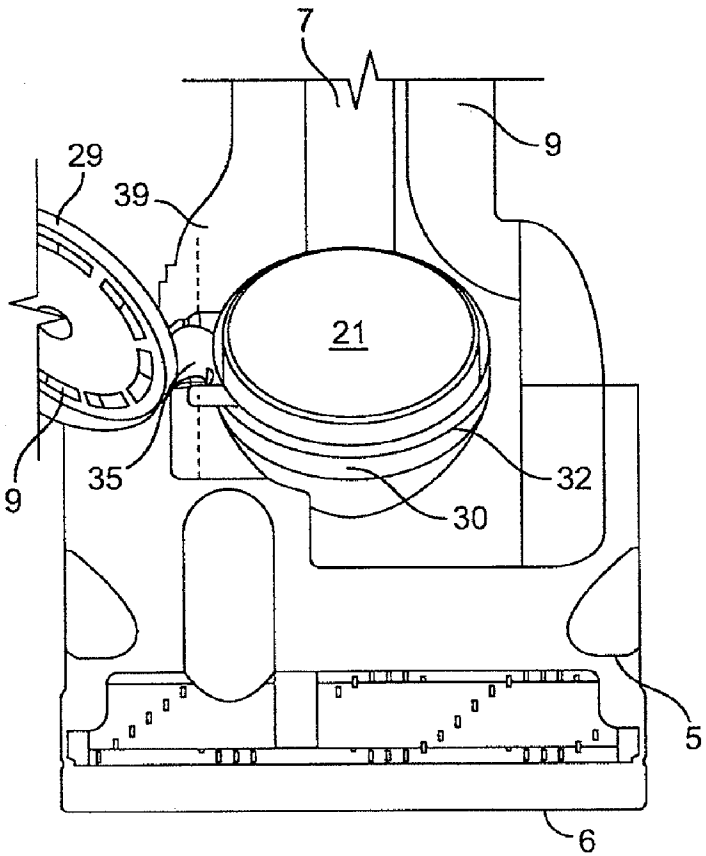
FIG. 5 is a front perspective view of part of the cleaner of FIG. 1 showing the door of the post-motor filter housing in an open position.
Figure 4:
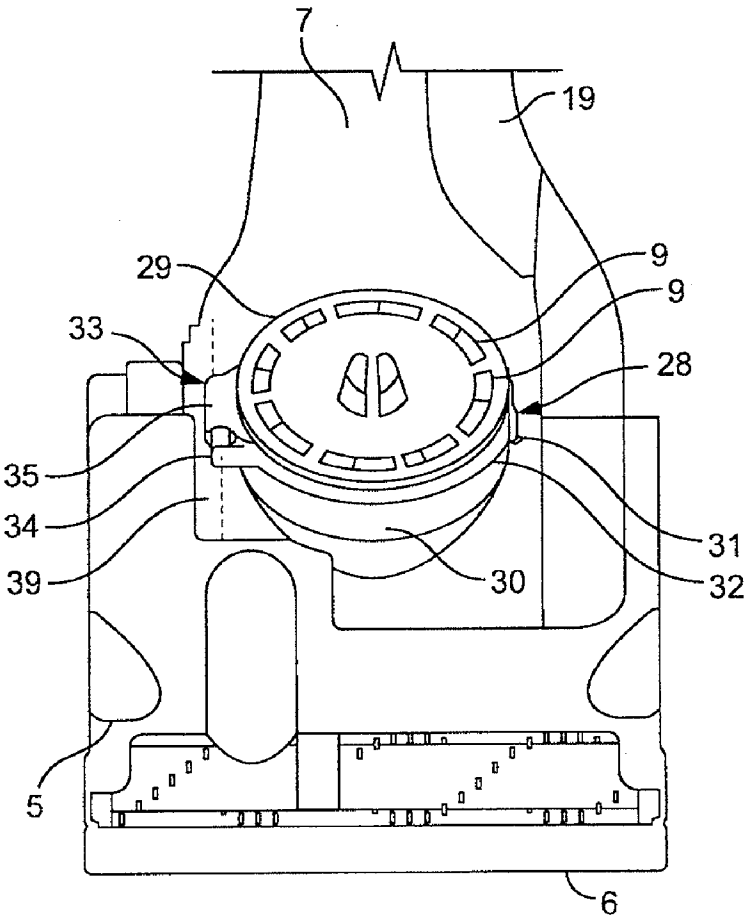
FIG. 4 is a front perspective view of part of the cleaner of FIG. 1 with the pre-motor filter housing removed.

With reference to FIGS. 3 to 5, the pre-motor filter 20 sits inside in a pre-motor filter housing 24 located alongside the motor and fan unit 3. The pre-motor filter housing 24 is attached to the main body 2 of the vacuum cleaner 1 by a first catch 25. The catch 25 comprises two user-operable buttons 26*a*, 26*b* located on opposing front and back portions of the pre-motor filter housing 24. The user simply releases the catch 25 by placing a thumb and forefinger on respective buttons 26*a*, 26*b* and squeezing the buttons towards one another. Thus, the catch 25 for the pre-motor filter housing 24 is intuitive to use. The catch 25 is manufactured so as to be conspicuous to the user; it may be made, for example, of a different colour to the components surrounding it, or it may have some visual indicia to draw the user's attention to it. It may also incorporate depressions in the buttons 26*a*, 26*b* to indicate to the user the position of the user's digits required to operate the catch 25.

When the pre-motor filter housing 24 has been released from the main body 2 of the vacuum cleaner 1, the pre-motor filter 20 may be removed from the housing for replacement by a new filter, or for cleaning, as shown in FIG. 3*b*. A tab 27 may be provided on the surface of the filter 20 to aid the user in removing it. Conveniently, the pre-motor filter 20 may be manufactured such that it is washable by the user. In this way, the user can maintain the vacuum cleaner 1 without having to purchase replacement parts or requiring the services of an engineer. The pre-motor filter 20 comprises a plurality of filter portions 20*a* of the same size and circular cross section.

The filter portions 20*a* are delimited by, and held adjacent one another by a deformable rim 20*b* formed around the edges of the filter portions. The deformable, pliable nature of the rim 20*b* means that the pre-motor filter 20 is flexible and capable of being squeezed by a user. The pliability of the rim 20*b* and the filter portions 20*a* facilitates an effective washing action, including the action of wringing out the filter to dry.

When the pre-motor filter 20 has been washed and dried, or when the user has acquired a new filter, the filter can simply be replaced in the pre-motor filter housing 24. A lip 20*c* on the deformable rim 20*b* assists the user in replacing the pre-motor filter 20 in the correction orientation in the pre-motor filter housing 24. The housing 24 can then be slotted back into its location near the motor and fan unit 3. The catch 25 is biased so as to re-engage automatically when the housing 24 is replaced on the main body 2 of the vacuum cleaner 1.

When the pre-motor filter housing 24 is removed from the main body 2 of the vacuum cleaner 1, a second catch 28 on the main body becomes visible and accessible, as shown in FIG. 4. This catch 28 is located underneath, and to the side of, the separating apparatus 10. When the separating apparatus 10 also is removed, the second catch 28 may be released by a user. This second catch 28 permits a door 29 to be opened. The door 29 is circular and lies in a generally vertical plane on the main body 2. When the separating apparatus 10 is attached to the main body 2, the door 29 lies within its footprint such that the door is hidden from the user. The door 29 is the opening of a second housing 30, which housing accommodates the post-motor filter 21. The door 29 incorporates the outlet ports 9 of the vacuum cleaner.

The second catch 28 comprises a flange 31 extending from the door 29 of the housing 30. The flange 31 is bent downwardly so as to engage with a lip 32 on the post-motor filter housing 30. The flange 31 is biased inwardly so as to retain the door 29 in a closed position against the post-motor filter housing 30. In order to release the catch 28, the user needs to pull on the flange 31 so that it flexes outwardly, away from the lip 32. The door 29 can then be opened.

Figure 6:
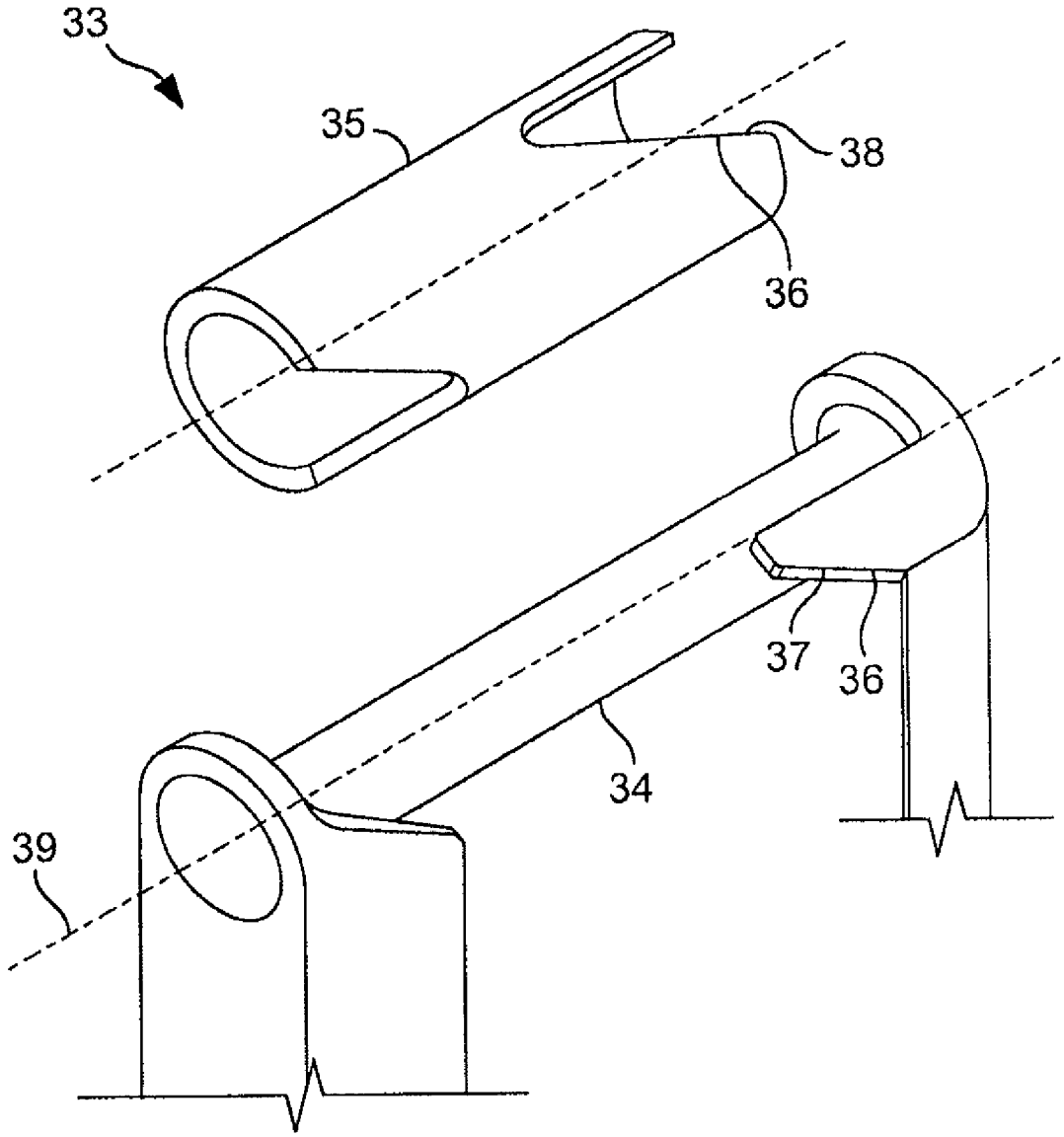
FIG. 6 is a perspective view of parts of the hinge of the door of FIG. 5.

The door 29 is attached to the main body 2 of the vacuum cleaner 1 by a hinge 33, which is shown in more detail in FIG. 6. The door 29 has been omitted from this drawing for clarity. The hinge 33 comprises an elongate pin 34, which is mounted in a generally horizontal plane on the main body 2; and a sleeve 35, which is formed on a side of the door 29. The sleeve 35 of the hinge 33 and the flange 31 are formed on opposite sides of the door 29. The sleeve 35 fits over the pin 34 and swivels around it, thereby allowing the door 29 to be swung open and closed.

Figure 7:
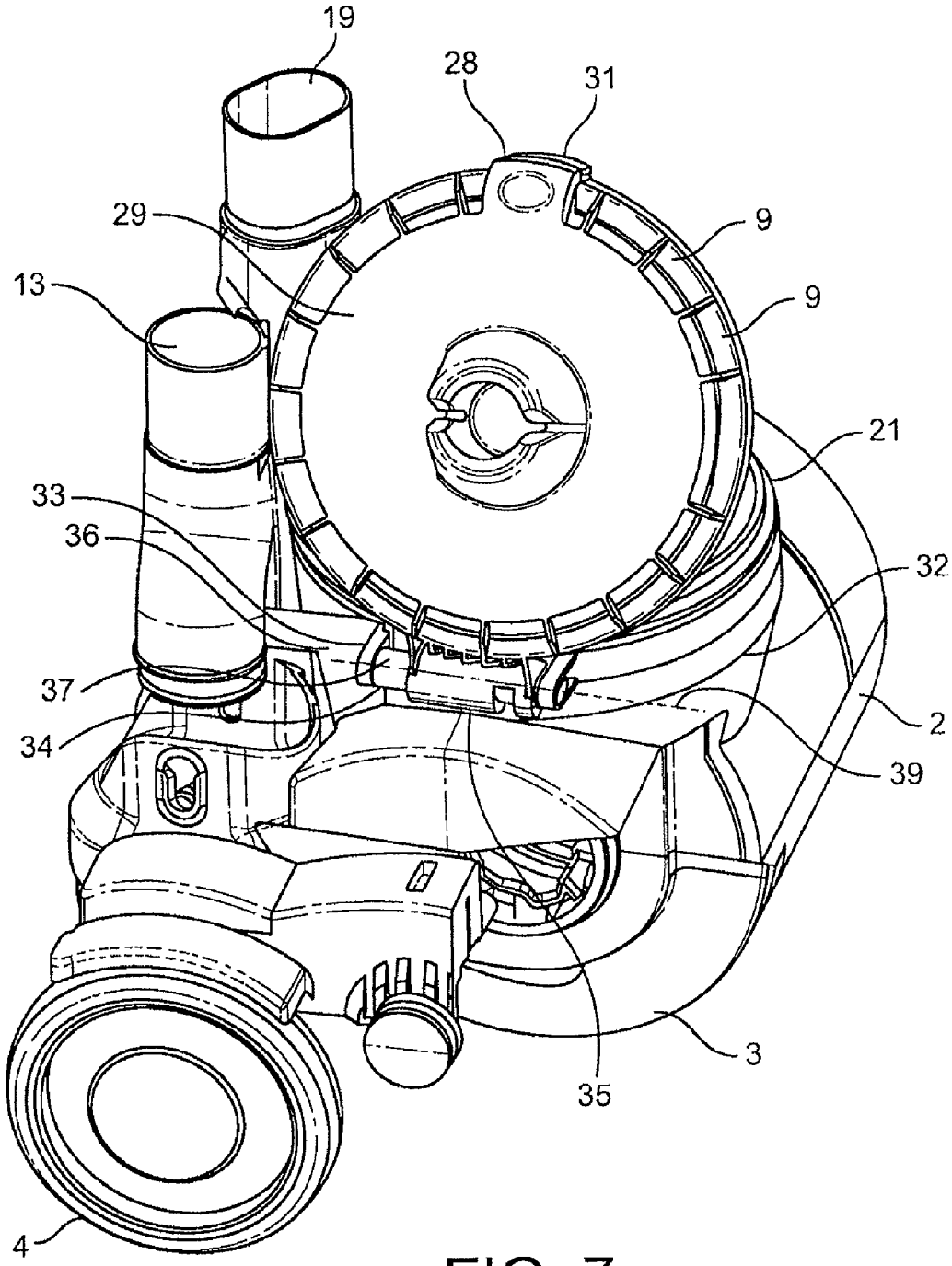
FIG. 7 is a side perspective view of part of the cleaner of FIG. 1 showing the door of the post-motor filter housing in an open position.

The hinge 33 is provided with a cam 36. In this embodiment, the cam 36 comprises a lug 37 on the end portion of the pin 34 nearest the spine 7 of the main body 2. A co-operating tapered portion 38 is formed in the sleeve 35 of the hinge 33. The cam 36 is arranged so that, as the door 29 is swung from the closed to the open position, the tapered portion 38 of the sleeve 35 bears against the lug 37, thus constraining the sleeve to move linearly as it is further rotated. The cam 36 urges the sleeve 35 of the hinge 33, and hence the door 29, away from the spine 7 of the main body 2. The door 29 moves by a combination of rotational and translational motion: the door pivots about the rotational axis 39 of the hinge and also moves along this axis. Hence, when manufacturing the vacuum cleaner 1 there is no need to provide sufficient clearance for the door 29 to open fully, as it automatically moves away from the main body 2 and any obstructions associated with it. This can be seen in the perspective view of FIG. 7.

Conventionally, the post-motor filter housing 30 and its door 29 has had to be located further forward on the main body 2 so that, when the door opens, it is clear of the spine 7 that extends upwardly from the main body 2, and any other components on the main body. This arrangement of the hinge 33 permits the post-motor filter housing 30 to be located close to the spine 7, allowing for a more compact cleaner 1 to be made.

When the post-motor filter housing 30 has been opened, as shown in FIG. 5, the post-motor filter 21 can be removed for replacement by a new filter, or for cleaning. Conveniently, the post-motor filter 21 may be manufactured such that it is washable by the user, in much the same way as the pre-motor filter 20. When the post-motor filter 21 has been washed and dried, or when the user has acquired a new filter, the filter can simply be replaced in the post-motor filter housing 30. The door 29 can then be swung back on its hinge 33 to the closed position. As it swings, the door 29 can also move linearly along the axis 39, back towards the spine 7 of the main body 2 by virtue of the arrangement of the cam 36. This permits the door 29 to assume its original position. The user then simply presses on the door 29 so that the lip 32 of the post-motor housing 30 bears against the flange 31 on the door 29. The force of the lip 32 against the flange 31 causes it to flex outwardly so that the door 29 can be pushed fully closed. The flange 31 is biased so as to re-engage automatically with the lip 32 and thereby hold the door 29 in its closed position.

The filter housings 24, 30 and respective catches 25, 28 are arranged so that the catch 28 of the post-motor filter housing 30 is not accessible, let alone releasable, while the pre-motor filter housing 24 is in place on the main body 2. Thus, the first catch 25 must be released, and the pre-motor filter housing 24 removed, before the second catch 28 may be operated by the user. However, when replacing the filters 20, 21, the catches 25, 28 may be re-engaged in either order. For example, the user may decide to replace the post-motor filter 21 and then close the door 29; followed by replacement of the post-motor filter housing 24. It is just as simple for the user firstly to replace the pre-motor housing 24, re-insert the post-motor filter 21 in its housing 30, and then close the door 29. The position of the pre-motor housing 24 and the first catch 25 with respect to the post-motor filter housing 30 gives sufficient clearance for the door 29 to be closed; the flange 31 does not impinge on the pre-motor filter housing 24 during closing of the door. When the door 29 has been closed, it resumes its position behind the catch 25 of the pre-motor filter housing 24, and so cannot be released again until the pre-motor filter housing has been removed from the main body 2.

Figure 8:
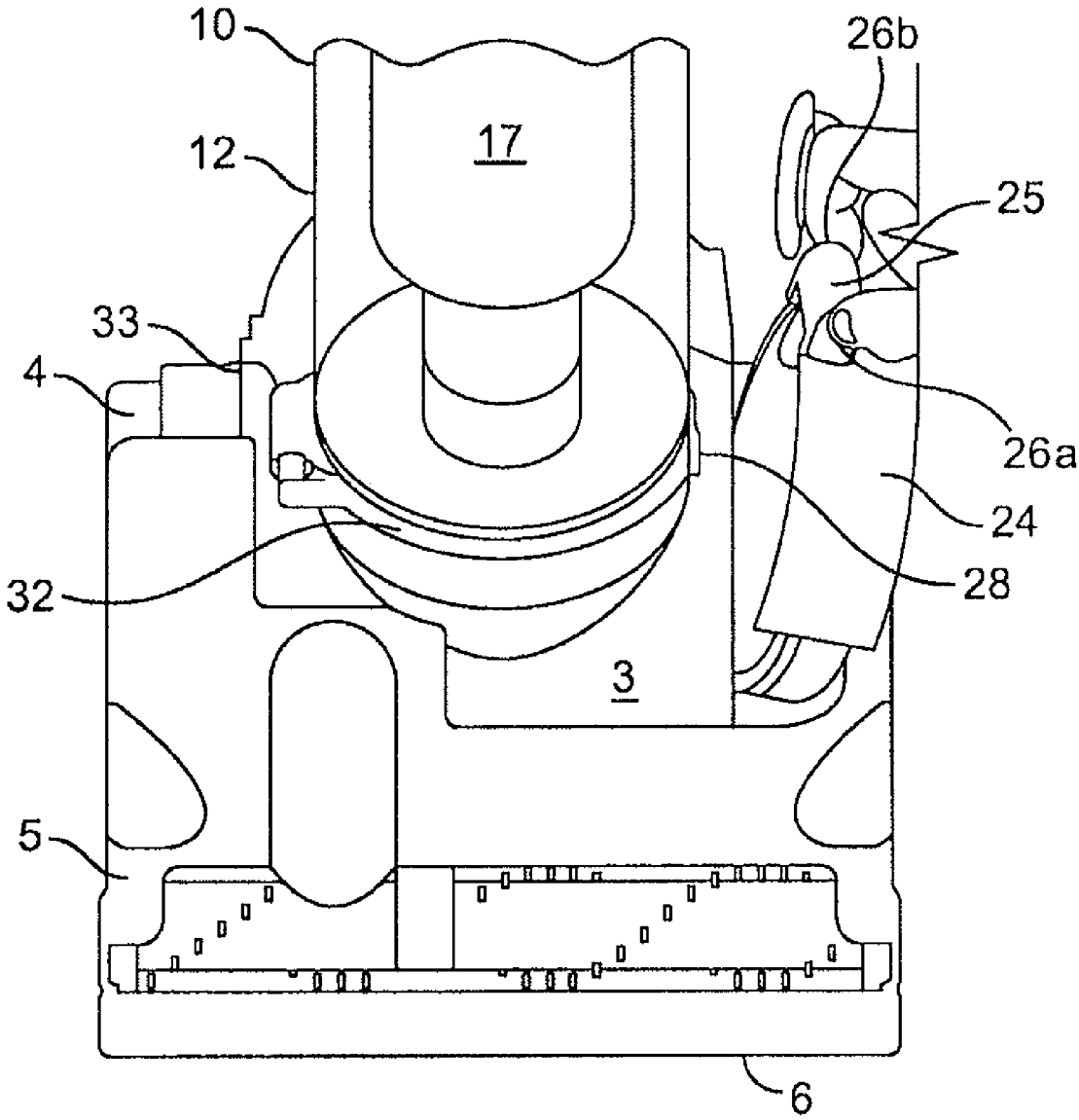
FIG. 8 is a front perspective view of part of the cleaner of FIG. 1 showing the pre-motor filter housing being removed with the separating apparatus in place.

The first catch 25 may be released, and the pre-motor filter housing 24 removed, while the separating apparatus 10 is attached to the main body 2 of the vacuum cleaner 1, as shown in FIG. 8. However, the separating apparatus 10 needs to be removed before the post-motor filter door 29 is openable, as the separating apparatus is mounted on the main body 2 directly over the door. This prevents the user from accessing the post-motor filter 21 more frequently than the user empties the separating apparatus 10.

The invention is not limited to the detailed description given above. Variations will be apparent to the person skilled in the art. For example, alternative arrangements of the cam 36 may be employed. The lug 37 may be located on the sleeve 35, with the co-operating taper 38 being formed as part of the pin 34. The hinge 33 may incorporate a screw thread arranged so that, as the door 29 turns, it also moves along the axis 39 away from the spine 7 of the main body 2. Alternatively, a rack and pinion arrangement may be provided.

The hinge 33 need not incorporate a cam 36. The pin 34 is longer than the sleeve 35, and extends beyond the sleeve, away from the spine 7 when the door is in the closed position.

Thus, if a hinge without a cam is employed, the user can elect to slide the door 29 axially along the rotational axis 39 in order that the door may open clear of any obstructions.

The hinge has been described with reference to opening the post-motor filter housing 30. However, similar hinge arrangements may be employed to provide access for other components. For example, the pre-motor filter housing 24 may be connected to the main body 2 by such a hinge arrangement. A cover permitting access to the motor and fan may also be hingedly connected in this way. Such an arrangement gives the user access to components that may need attention without adding to the overall size of the cleaner.

The first catch 25 for the pre-motor filter housing 24 and the second catch 28 for the post-motor filter housing 30 have been described as separately and independently manually operable. However, the second catch 28 may be automatically released in dependence on removal of the pre-motor filter housing 24. This may be effected by, for example, a protrusion on the pre-motor filter housing 24 arranged so that, as the housing is lifted, the protrusion bears against the flange 31, flexing it away from the lip 32 on the post-motor housing 30. In this manner, the second catch 28 and hence the door 29 are automatically released. Alternatively, the second catch may be mechanically linked to the pre-motor filter housing 24. As a further alternative, an electromechanical arrangement may be employed wherein the second catch 28 is held in a locked position until such time as the pre-motor filter housing 24 is removed. A Hall sensor arrangement is suitable for this purpose.

The separating apparatus need not be a cyclonic separator. Other forms of separating apparatus could be used, for example, a porous bag or filter. Additionally, the separating apparatus need not be located in the collecting chamber. A separate collecting chamber may be provided.

The cleaning appliance need not be an upright vacuum cleaner. The invention is applicable to other types of vacuum cleaner, for example, cylinder machines, stick-vacuums or hand-held cleaners. Further, the present invention is applicable to other types of cleaning appliances, for example, a wet and dry machine or a carpet shampooer.

The invention claimed is:

1. A surface-treating appliance, comprising a main body housing a component, and a door arranged to provide access to the component, the door being connected to the main body by a hinge having a rotational axis, in which the hinge is arranged to allow the door to pivot about the rotational axis and to move along the rotational axis as the door is moved between closed and open positions.

2. The surface-treating appliance as claimed in claim 1, in which the hinge includes a cam.

3. The surface-treating appliance as claimed in claim 2, in which the hinge comprises a pin and a sleeve arranged to be capable of rotating on the pin, and the cam comprises a lug on the pin and a co-operating tapered portion on the sleeve.

4. The surface-treating appliance as claimed in claim 1 or 2, in which the appliance includes a spine, and the rotational axis of the hinge is transverse to the spine.

5. The surface-treating appliance as claimed in claim 1 or 2, in which the door is held in a closed position by a manually-operable catch.

6. The surface-treating appliance as claimed in claim 1 or 2, in which the door is arranged to provide access to a filter housing.

7. The surface-treating appliance as claimed in claim 6, in which the filter is removable from the main body.

8. The surface-treating appliance as claimed in claim 7, in which the filter is washable.

9. A vacuum cleaner comprising the surface-treating appliance as claimed in claim 1 or 2.

10. The vacuum cleaner as claimed in claim 9, comprising at least one cyclonic separator.

* * * * *